US006253678B1

(12) United States Patent
Wentworth

(10) Patent No.: US 6,253,678 B1
(45) Date of Patent: Jul. 3, 2001

(54) METHOD OF PRINTING TO REDUCE MISREGISTRATION

(75) Inventor: Douglas F. Wentworth, Fort Collins, CO (US)

(73) Assignee: R. R. Donnelley & Sons, Chicago, IL (US)

( * ) Notice: Subject to any disclaimer, the term of this patent is extended or adjusted under 35 U.S.C. 154(b) by 0 days.

(21) Appl. No.: 09/275,551

(22) Filed: Mar. 24, 1999

(51) Int. Cl.[7] ..... B41F 13/12
(52) U.S. Cl. ..... 101/181; 101/211; 101/486
(58) Field of Search ..... 101/181, 211, 101/219, 228, 248, 484, 485, 486, DIG. 36

(56) References Cited

U.S. PATENT DOCUMENTS

| | | | | |
|---|---|---|---|---|
| 4,273,045 | * | 6/1981 | Crowley | 101/181 |
| 4,484,522 | * | 11/1984 | Simeth | 101/181 |
| 4,485,982 | * | 12/1984 | St. John et al. | 101/484 |
| 4,532,596 | | 7/1985 | Pugsley | 364/469 |
| 4,546,700 | * | 10/1985 | Kishner et al. | 101/181 |
| 4,690,051 | * | 9/1987 | Kishine et al. | 101/181 |
| 5,069,124 | * | 12/1991 | Schneider | 101/142 |
| 5,295,236 | | 3/1994 | Bjorge et al. | 395/134 |
| 5,365,847 | | 11/1994 | Pers | 101/248 |
| 5,500,801 | * | 3/1996 | Loffler | 101/486 |
| 5,505,129 | * | 4/1996 | Greb et al. | 101/484 |
| 5,662,044 | | 9/1997 | Löffler et al. | 101/492 |
| 5,760,914 | | 6/1998 | Gauthier et al. | 358/298 |
| 5,797,320 | | 8/1998 | Buschulte et al. | 101/226 |
| 5,806,430 | | 9/1998 | Rodi | 101/484 |

* cited by examiner

*Primary Examiner*—Stephen R. Funk
(74) *Attorney, Agent, or Firm*—Marshall, O'Toole, Gerstein, Murray & Borun

(57) ABSTRACT

A method of printing using a press having first and second printing units and responsive to electronic data includes the steps of running the press to cause first and second printing units to produce first and second printed components, respectively, on a substrate, stopping the press and inspecting the first and second printed components to determine a degree of misregistration of the first printed component relative to the second printed component caused by substrate growth. Original electronic data representing an image to be printed by the press are modified in dependence upon the degree of misregistration. The press is subsequently operated in accordance with the modified electronic data to print the image with a reduced degree of misregistration.

27 Claims, 2 Drawing Sheets

METHOD OF PRINTING TO REDUCE MISREGISTRATION

TECHNICAL FIELD

The present invention relates generally to printing methods, and more particularly, to a method of printing which reduces misregistration errors during the printing process.

BACKGROUND ART

During an offset printing process paper travels through multiple printing units which sequentially apply different image separations or components to the paper. This process requires the application of ink and fountain solution to the paper, which often changes the dimensions of the paper. One factor contributing to such growth is exposure of the paper to liquids. As the paper receives each application of ink and fountain solution, the paper expands resulting in an overall increase in the dimension perpendicular to the grain of the paper. In a web offset press, the grain of the paper usually runs parallel to the length of the paper web, and hence, growth typically occurs across the width of the paper web. Although the web width continually expands as the web passes through each printing unit, each successive increase is smaller than the previous increase, resulting in differential growth.

Because growth alters the original dimensions of the paper, the printed color images do not align correctly and create distorted images. This misalignment of the color images is referred to as misregistration. During a four-color printing process, the colors cyan, magenta, yellow and black are typically used to build a spectrum of colors. For example, to produce green, the colors cyan and yellow are overlapped. When paper growth occurs, the printed colors become misaligned, leaving a blue edge on one side of the image and a yellow edge on the other side of the image. These misregistered colors undesirably reduce image reproduction quality. To correct such gross misregistration of images, printing presses must frequently be stopped during the printing process and realigned to reduce waste. This method of correction is costly and has resulted in significant press downtime.

Historically, various techniques have been developed to adjust for registration variances caused by paper growth. Two well-known methods of correcting registration errors are the shift method and the trap method. The shift method makes adjustments to the alignment of individual page color separations in prepress by shifting the page image for each separation into a position that will cause the images to register in the center of each page when paper growth occurs. One disadvantage to this method is that shifting often brings page images into close, but not perfect, register. The trap method requires printing ink over previously printed ink to abut misaligned color images. Like the shift method, the trap method corrects for misregistration by making misalignment less noticeable, yet does not completely eliminate registration errors. Also, trapping is a complicated process utilizing algorithms that require large amounts of CPU processing time when performed by a computer. Trapping algorithms can further result in undesirable image appearance in certain circumstances. In addition, trapping can result in increased ink usage, in turn leading to the possibility of substrate over-saturation and resultant smearing and offsetting which contribute to undesirable quality and detract from the reasons for trapping in the first place.

Other methods track the movement of a paper web through the printing press by using detecting means, usually an optical monitoring assembly, to obtain data for correction of misregistration. In U.S. Pat. No. 5,365,847, a control system for a printing press is described in which a pair of sensing assemblies located on opposite sides of the web detect and gather information concerning fan-out or expansion of the paper web. Within the control system, a central processing unit receives signals from the sensors and automatically corrects the misaligned printing image by supplying the appropriate signals to electronic image devices associated with the printing cylinders of the press.

In U.S. Pat. No. 5,806,430, a digital printing press includes an automatic register adjustment for a plurality of digital imaging units to correct register errors occurring during the printing process. Specifically, the press includes an error detection device having sensors which detect printed registration marks to generate register error signals, an image modification circuit connected to the sensors for receiving the error signals to modify image data and thereby correct register errors and a raster image processor to receive the modified image data in preparation for printing. Register adjustment can be carried out continuously during the printing process.

While the above-mentioned solutions correct misregistration by employing the use of measuring instruments and image processing equipment to make adjustments to the images during the printing process, these techniques are not desirable because of the high costs of the necessary equipment to implement same. Furthermore, current methods to correct misregistration errors are objectionable because they only correct errors occurring during the printing process.

SUMMARY OF THE INVENTION

In accordance with one aspect of the present invention, a method of printing using a press having first and second printing units and responsive to electronic data includes the steps of running the press to cause the first and second printing units to produce first and second printed components, respectively, on a substrate and stopping the press. The first and second printed components are inspected to determine a degree of misregistration of the first printed component relative to the second printed component caused by growth of the substrate. Original electronic data representing an image to be printed by the press are modified in dependence upon the degree of misregistration and the press is subsequently operated in accordance with the modified electronic data to print the image with a reduced degree of misregistration.

Preferably, the step of modifying comprises the step of anamorphically scaling and, optionally, offsetting the electronic data. The step of modifying may comprise the step of scaling the electronic data in a direction corresponding to substrate width but not in a direction corresponding to substrate length. Also preferably, the step of running comprises the step of conducting a test press run to print a test pattern.

Still further in accordance with the preferred embodiment, the step of inspecting comprises the step of visually observing the printed components and measuring the misregistration. This step is preferably accomplished by measuring the misregistration at opposing sides of the substrate. Also in accordance with the preferred embodiment, the press comprises an offset press.

In accordance with another aspect of the present invention, a method of printing using an offset web press having N printing units and responsive to electronic image data representing an image, where N is an integer greater than 1, includes the steps of conducting a test press run to cause the printing units to print N printed components on a web. The press is stopped and the printed components are inspected to determine a degree of misregistration of N−1 printed components relative to a remaining printed component wherein the misregistration is caused by growth of the web in a direction transverse to web length. The electronic image data are modified in dependence upon the degree of misregistration and the press is subsequently operated in accordance with the modified electronic data to print the image with a reduced degree of misregistration.

In accordance with yet another aspect of the present invention, a method of printing using an offset web press having N printing units and responsive to electronic image data having N data sets representing N image components, respectively, of an image where N is an integer greater than 1, includes the step of conducting a test press run to cause the printing units to print N printed components on a web. The press is stopped and the printed components are inspected to determine a degree of misregistration of each of N−1 printed components relative to a remaining printed component wherein the misregistration is caused by growth of the web in a direction transverse to web length. N−1 data sets defining N−1 image components are anamorphically scaled and offset in dependence upon the degrees of misregistration to obtain modified electronic data. The press is subsequently operated in accordance with the modified electronic data to print the image components with a reduced degree of misregistration.

Other aspects and advantages of the present invention will become apparent upon consideration of the following drawings and detailed description.

DESCRIPTION OF THE PREFERRED EMBODIMENTS

Figure 1:
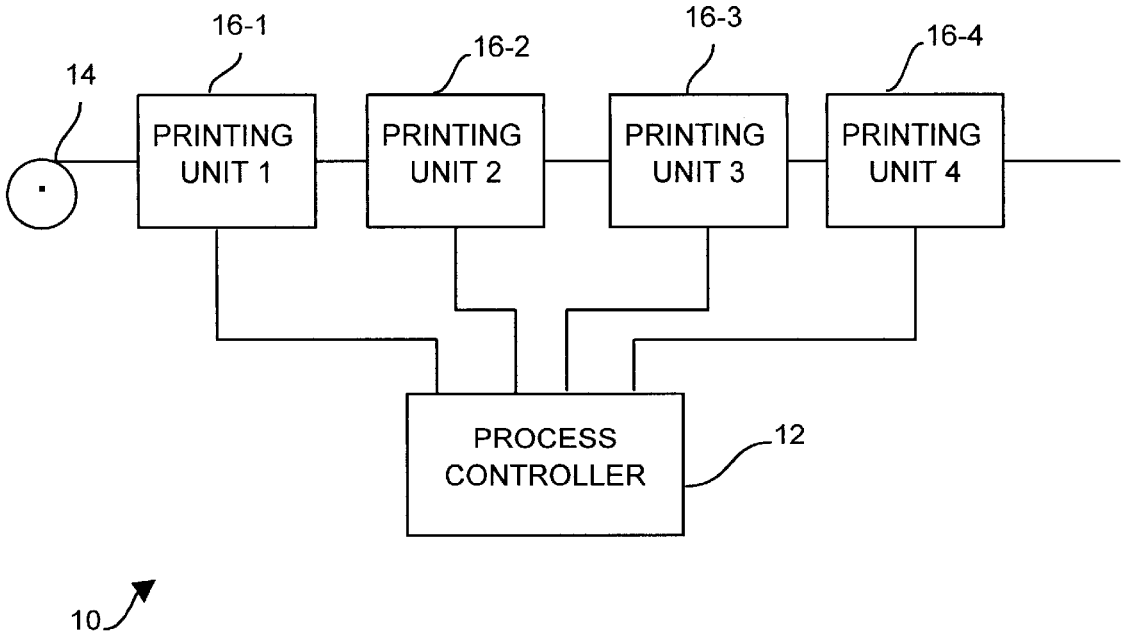
FIG. 1 is a block diagram of an offset web press system with which the method of the present invention may be used.

Referring first to FIG. 1, a computer-to-plate offset web press system 10 includes a press controller 12 which controls four printing units 16-1 through 16-4 that print cyan, magenta, yellow and black image components or separations on a paper substrate or web 14. It should be noted that the present invention can be used with any press system having N printing units that print N image components on a substrate, such as sheet-fed paper or a web, where N is an integer greater than 1. In the general case, the printing units 16 may print different colors or some or all may print the same color, as desired, and/or the colors may be other than cyan, magenta, yellow and black.

Figure 2:
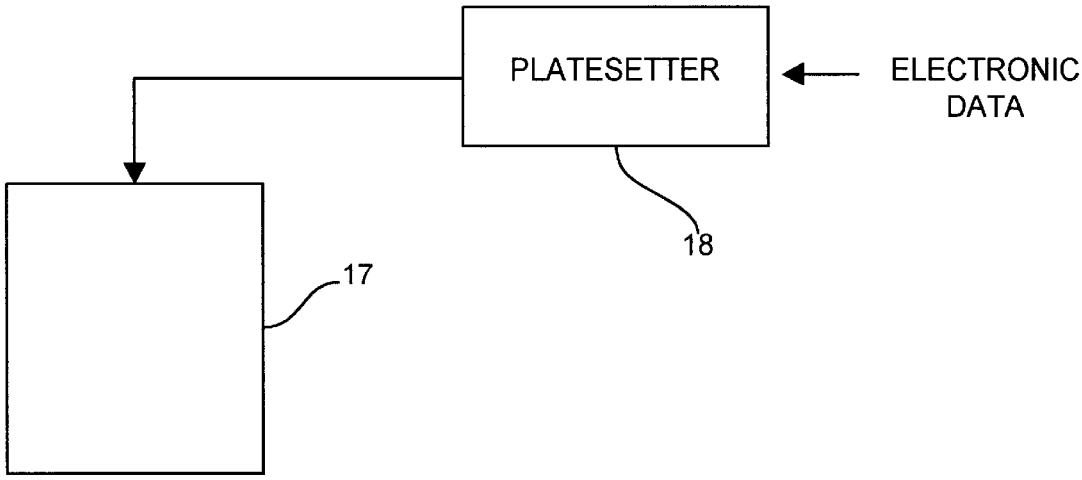
FIG. 2 is a block diagram of a plate setter and a printing plate.

Referring to FIG. 2, the offset web press system 10 utilizes aluminum printing plates 17 which are imaged by a plate setter 18 which is, in turn, responsive to electronic data representing one or more images to be printed. The plate setter 18 receives the electronic data from any suitable data source, for example, a computer running page imposition software, a computer running page make-up software, a storage device, or the like. In the preferred embodiment, the electronic data include four data sets wherein each data set represents an image component or separation and controls production of a plate 17 for one of the printing units 16-1 through 16-4. That is, the electronic data include a cyan data set representing the image component to be printed by the printing unit 16-1, a magenta data set representing the image component to be printed by the printing unit 16-2, a yellow data set representing the image component to be printed by the printing unit 16-3, and a black data set representing the image component to be printed by the printing unit 16-4. In the more general case, the electronic data include N data sets, one for each printing unit operated by the press controller 12. Also, the present invention could be used in a press utilizing digital press cylinders that can be imaged while in the press units or may be used in a different press, if desired.

Figure 3:
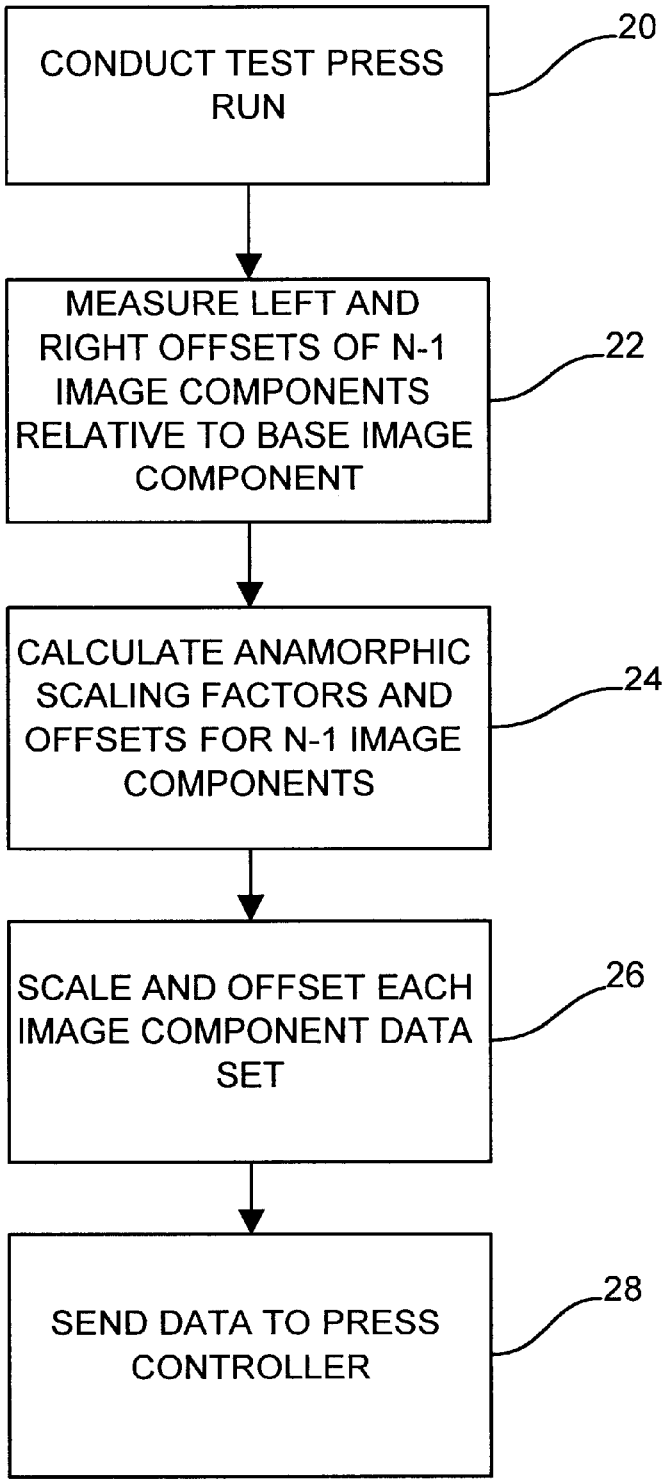
FIG. 3 is a block diagram illustrating a preferred form of the method of the present invention.

FIG. 3 illustrates the method according to the present invention. The method begins at a block 20 at which a test press run is conducted by using test plates 17 and running the press to cause the printing units 16-1 through 16-4 to produce printed components on the web 14. In the preferred embodiment, at least two multi-color registration marks are printed on opposite sides of the web sheet and the same registration mark image is printed at 100% scale using all printing units 16-1 through 16-4. Each registration mark preferably comprises a cross hair mark consisting of overlapping horizontal and vertical lines of equal length and thickness. In the preferred embodiment, each line is approximately 0.25" in length and 0.004" in thickness, although these dimensions can be varied, if desired. Preferably, the test press run should include typical content for the product to be produced (i.e., content comprising average product image(s) to be produced in a subsequent mass production run) so that the web 14 is exposed to substantially the same amounts of ink and fountain solution as during a production press run. This ensures that the degree of web growth experienced during the test press run is substantially equal to the growth expected during subsequent production. Alternatively, a different image or set of images may instead be produced during the test run. Once the test press run is complete, the press system 10 is stopped and the printed components on the web 14 are inspected to determine one or more degrees of misregistration of printed components thereon. In the preferred embodiment, this is accomplished at a block 22 by measuring the offsets of the first three components (i.e., the cyan, magenta and yellow components) relative to the remaining or base component (i.e., the black component). If desired, the offsets of any other three components may be measured relative to the remaining component.

The misregistration that occurs as a result of application of fountain solution and ink to the web 14 is measured using a high power magnifying glass with the capability to visualize and measure in thousandths of inches. The amount of misregistration is measured at each registration mark by measuring the amount of offset of the cyan, magenta and yellow mark components relative to the black component. The registration marks, are preferably (although not necessarily) in vertical alignment with the left and right edges of the web image components (e.g., directly above the left and right edges of the printed image on the web). Because of this placement, the misregistration is measured at opposite sides of the web. In other words, when the width of the web is oriented left-to-right, the amount of misregistration of each of the cyan, magenta and yellow colors relative to the black color is measured at the left-hand and right-hand printed portions of the web so that two measurements are obtained per printed component.

The misregistration offsets measured at the left registration mark are denoted $M01_{cyan}$, $M01_{magenta}$, and $M01_{yellow}$, whereas the misregistration offsets measured at the right registration mark are denoted $M02_{cyan}$, $M02_{magenta}$, and $M02_{yellow}$, These values are negative in magnitude if the corresponding registration mark component is located toward the center of the web relative to the black registration mark component and are positive if the corresponding registration mark component is located toward the outer edges of the web relative to the black registration mark component. These terms are combined with a term $W_B$ representing the width of the black image component (which is a known quantity or may be measured) to obtain image component widths $W_i$ as follows:

$$W_i=W_B+M01_i+M02_i \tag{1}$$

where $W_i$ is the width of the ith image component (i=1,2, . . . N−1). In the case where cyan, magenta and yellow are printed together with black, and where black is the base component, equation 1 results in calculation of three quantities $W_{cyan}$, $W_{magenta}$ and $W_{yellow}$ as follows:

$$W_{cyan}=W_B+M01_{cyan}+M02_{cyan} \tag{2a}$$

$$W_{magenta}=W_B+M01_{magenta}+M02_{magenta} \tag{2b}$$

$$W_{yellow}=W_B+M01_{yellow}+M02_{yellow} \tag{2c}$$

From the measurements obtained at the block 22, anamorphic scaling factors and, optionally, offsets for the cyan, magenta and yellow image components are obtained at a block 24. By "anamorphic" is meant that the scaling factor relates to scaling in one dimension but not the other dimension of the image to be printed on the web 14. In this step, the last printing unit 16 to apply an image to the web 14 (i.e., the black printing unit 16-4) is considered the target size for the all of the image components. The scaling factors are calculated as follows to duplicate the size of the image applied by the printing unit 16-4 after web growth has occurred (the use of Microsoft EXCEL® spreadsheets is a convenient way to record and calculate this data):

$$S_i = \frac{W_B}{W_i} \tag{3}$$

where $S_i$ represents the width scaling factor for the image to be printed by the ith printing unit, where i equals 1, 2, . . . N−1, $W_B$ is equal to the width of the image applied by the Nth or last printing unit (in the preferred embodiment the printing unit 16-4) and $W_i$ is the width (unscaled) of the ith image printed by the ith printing unit. In the preferred embodiment, the foregoing results in scaling factors $S_{cyan}$, $S_{magenta}$ and $W_{yellow}$ for the data sets representing the cyan, magenta and yellow image components, respectively.

Because the data representing the image components are being scaled at different widths, the plates produced from such data will not be physically aligned at all points from press cylinder to press cylinder. Generally, there is a specific point on a press cylinder which is considered ideal as an alignment point. Preferably, the center point of each press unit is chosen as the alignment point so that the amount of adjustments necessary at press time to align unit images relative to one another is minimized. In the case where a particular press cylinder in a printing unit 16 uses only one printing plate 17, the offset for the plate is calculated as follows:

$$O_i = \frac{W_i - (S_i * W_i)}{2} \tag{4}$$

wherein $O_i$ is the offset for the image to be printed by the ith printing unit (where i=1,2, . . . N−1) and $S_i$ is the scaling factor for the ith printing unit as noted above. The equation (4) above results in offsets $O_{syan}$, $O_{magenta}$, and $O_{yellow}$ for the data sets representing the cyan, magenta, and yellow image components, respectively. For example, in a case where scaling calls for a reduction of a 75" wide cyan plate image to 99.827%, the formula (4) above results in calculation of an offset $O_{cyan}$ as follows:

$$O_{cyan}=(75-(75*0.99827))/2=0.064875 \tag{5}$$

This offset would result in shifting of the cyan plate image 0.065" to the right.

It should be noted that one or more of the printing units 16 could utilize more than one printing plate 17 therein, in which case an offset may not be needed for every plate 17.

Following the block 24, the data sets for the N−1 image components are modified (block 26) by transformation to scale and offset same relative to the data set for the base image component.

At this point, the modified image data can be sent to the plate setter 18 (block 28) to produce plates 17 for cylinders in the printing units 16. The plates 17 may then be used by the printing units 16 during a production press run. Alternatively, one or more further test runs can be conducted using test data similar or identical to the test pattern noted above, or other image data modified in accordance with the scaling factors and offsets as determined above. The resulting output from the test run(s) can be measured in the fashion noted above and new anamorphic scaling factors and offsets can be calculated and used to modify the data sets for the image components. This process can be repeated as many times as necessary to obtain data sets that result in printed image components that are within register to an acceptable degree. Once this condition has been satisfied, plates 17 can be produced, mounted onto the cylinders of the printing units 16 and the press system 10 can be operated to produce printed output during a production press run.

The scaling and offsetting of each image component data set accomplished at the block 26 may be effected utilizing PREPS imposition software (PREPS is a trademark of Scenicsoft, Inc. of Everett, Wash.) that provides the ability to scale a template image. This scaling is undertaken while processing a PREPS job. Generally, the operator processing the PREPS job selects a template from a signature window and then selects a feature "layout details" which gives the operator the ability to scale the image. The operator indicates the scaling amount for the image component data set. Additional adjustments can also be entered to adjust the offset of the plate image on the plate. This offset factor is entered in the PREPS "device setup" option of the software.

The method of the present invention is not limited to the use of PREPS imposition software. Other software packages may also offer the ability to scale and/or offset plate images and could, therefore, be used. In addition, different types, weights, or thicknesses of paper may require different scaling factors. Tests may be necessary to determine appropriate web-growth adjustments for different paper attributes.

As also noted above, the method of the present invention is usable in the more general case where N printing units are responsive to electronic image data representing N image components, where N is an integer greater than 1. In this general case, a test press run is conducted to cause the printing units 16 to print N printed components on a substrate. The press is then stopped and the printed components are inspected to determine a degree of misregistration of each of N−1 printed components relative to a remaining printed component. The N−1 data sets defining the N−1 image components in the image to be reproduced are anamorphically scaled and, optionally, offset, in dependence upon the degrees of misregistration to obtain modified electronic data and the press is subsequently operated in accordance with the modified electronic data to print the image components with a reduced degree of misregistration.

If desired, the images may be scaled in more than one direction rather than anamorphically scaled. For example, scaling may be effected not only across the width of the substrate, but along the length of the substrate, if necessary or desirable. In this case, the scaling factors for the two dimensions may or may not be equal. Also, the present method may be used in combination with other misregistration correction methodologies, such as trapping. In this case, the required degree of trapping may be reduced owing to the misregistration reduction effected by the present invention.

The present invention operates open-loop and does not require expensive sensing devices and complicated controls. The resulting output is of acceptable quality and the method is inexpensive and simple to implement.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. A method of printing using a press having first and second printing units and responsive to electronic data wherein the electronic data include a first set of data representing a first image component to be printed by the first printing unit and a second set of data representing a second image component to be printed by the second printing unit after the first image component is printed, the method comprising the steps of:

running the press to cause the first and second printing units to produce the first and second printed components, respectively, on a substrate;

stopping the press;

inspecting the first and second printed components to determine a degree of misregistration of the first printed component relative to the second printed component caused by growth of the substrate;

modifying the first set of data in dependence upon the degree of misregistration while leaving the second set of data unmodified; and subsequently operating the press in accordance with the modified first set of data and the unmodified second set of data to print the image with a reduced degree of misregistration.

2. The method of claim 1, wherein the step of modifying comprises the step of anamorphically scaling the first set of data.

3. The method of claim 1, wherein the step of modifying comprises the step of anamorphically scaling and offsetting the first set of data.

4. The method of claim 1, wherein the step of modifying comprises the step of scaling the first set of data in a direction corresponding to substrate width but not in a direction corresponding to substrate length.

5. The method of claim 1, wherein the step of running comprises the step of conducting a test press run to print a test pattern.

6. The method of claim 1, wherein the step of inspecting comprises the step of visually observing the printed components and measuring the misregistration.

7. The method of claim 1, wherein the step of inspecting comprises the step of visually observing the printed components and measuring the misregistration at opposing sides of the substrate.

8. The method of claim 1, wherein the press comprises an offset press.

9. A method of printing using an offset web press having N printing units wherein each printing unit is responsive to an associated one of N electronic image data sets representing N image components, respectively, and wherein the printing units are operable in a sequence from a first printing unit to the Nth printing unit, where N is an integer greater than 1, the method comprising the steps of:

conducting a test press run to cause at least two of the printing units to print printed components on a web; stopping the press;

inspecting the printed components to determine a degree of misregistration of the printed components wherein the misregistration is caused by growth of the web in a direction transverse to web length;

modifying at least the electronic image data set associated with the first printing unit in dependence upon the degree of misregistration; and subsequently operating the press in accordance with at least the modified electronic image data set to print the image components with a reduced degree of misregistration.

10. The method of claim 9, wherein the step of modifying comprises the step performing a transformation on N−1 electronic image data sets.

11. The method of claim 10, wherein the step of performing the transformation comprises the step of anamorphically scaling the N−1 electronic image data sets.

12. The method of claim 10, wherein the step of performing the transformation comprises the step of anamorphically scaling and offsetting the N−1 electronic image data sets.

13. The method of claim 9, wherein the step of modifying comprises the step of scaling N−1 electronic image data sets in a direction corresponding to web width but not in a direction corresponding to web length.

14. The method of claim 9, wherein the step of inspecting comprises the step of visually comparing placement of N−1 printed components relative to placement of an N th printed component and measuring the misregistration.

15. The method of claim 9, wherein the step of inspecting comprises the step of visually observing the printed components and measuring the misregistration at opposing sides of the substrate.

16. A method of printing using an offset web press having N printing units and responsive to electronic image data having N data sets representing N image components, respectively, of an image where N is an integer greater than 1, the method comprising the steps of:

conducting a test press run to cause the printing units to print N printed components on a web;

stopping the press;

inspecting the printed components to determine a degree of misregistration of each of N−1 printed components relative to a remaining printed component wherein the misregistration is caused by growth of the web in a direction transverse to web length;

anamorphically scaling and offsetting N−1 data sets defining N−1 image components in dependence upon the degree of misregistration to obtain modified electronic data, wherein the scaling is accomplished by calculating scaling factors:

$$S_i = W_B / W_i$$

where $S_i$ represents a width scaling factor for an image component to be printed by the ith printing unit, where i equals 1, 2, . . . N−1, $W_B$ is equal to the width of the image applied by the Nth printing unit and $W_i$ is the unscaled width of the ith image printed by the ith printing unit, and wherein the offsetting is accomplished by calculating offsets:

$$O_i = (W_i - (S_i * W_i))/2$$

where $O_i$ is the offset for the image to be printed by the ith printing unit, where i equals 1, 2, . . . N−1; and subsequently operating the press in accordance with the modified electronic data to print the image components with a reduced degree of misregistration.

17. The method of claim 16, wherein the step of anamorphically scaling and offsetting comprises the step of modifying the electronic image data in a direction corresponding to web width but not in a direction corresponding to web length.

18. The method of claim 16, wherein the step of inspecting comprises the step of visually comparing placement of the N−1 printed components relative to placement of the remaining printed component and measuring the misregistration.

19. The method of claim 16, wherein the step of inspecting comprises the step of visually observing the printed components and measuring the misregistration at opposing sides of the web.

20. A method of printing using a computer-to-plate press having first and second printing units wherein the first and second printing units are operable in a sequence from the first printing unit to the second printing unit in response to first and second electronic data sets, respectively, the method comprising the steps of:

running the computer-to-plate press to cause the first and second printing units to produce first and second printed components, respectively, on a substrate;

stopping the computer-to-plate press;

inspecting the first and second printed components to determine a degree of misregistration of the printed components caused by growth of the substrate;

modifying the first electronic data set in dependence upon the degree of misregistration;

producing printing plates for the computer-to-plate press in accordance with the modified first electronic data set and the second electronic data set; and subsequently operating the computer-to-plate press using the produced printing plates to print the image with a reduced degree of misregistration.

21. The method of claim 20, wherein the step of modifying comprises the step of anamorphically scaling the first electronic data set.

22. The method of claim 20, wherein the step of modifying comprises the step of anamorphically scaling and offsetting the first electronic data set.

23. The method of claim 20, wherein the step of modifying comprises the step of scaling the first electronic data set in a direction corresponding to substrate width but not in a direction corresponding to substrate length.

24. The method of claim 23, wherein the step of running comprises the step of conducting a test press run to print a test pattern.

25. The method of claim 24, wherein the step of inspecting comprises the step of visually observing the test pattern and measuring the misregistration.

26. The method of claim 25, wherein the step of inspecting further comprises the step of measuring the misregistration at opposing sides of the substrate.

27. The method of claim 26, wherein the computer-to-plate press comprises an offset press.

* * * * *

UNITED STATES PATENT AND TRADEMARK OFFICE

CERTIFICATE OF CORRECTION

PATENT NO. : 6,253,678 B1
DATED : July 3, 2001
INVENTOR(S) : Wentworth

It is certified that error appears in the above-identified patent and that said Letters Patent is hereby corrected as shown below:

Column 8,
Line 52, replace "N th" with -- Nth --

Signed and Sealed this

Fifteenth Day of January, 2002

*Attest:*

*Attesting Officer*

JAMES E. ROGAN
*Director of the United States Patent and Trademark Office*